US010460663B2

(12) United States Patent
Hack et al.

(10) Patent No.: US 10,460,663 B2
(45) Date of Patent: Oct. 29, 2019

(54) ARCHITECTURE FOR VERY HIGH RESOLUTION AMOLED DISPLAY BACKPLANE

(71) Applicant: Universal Display Corporation, Ewing, NJ (US)

(72) Inventors: Michael Hack, Ewing, NJ (US); Michael S. Weaver, Ewing, NJ (US); Chun Hsin Liu, Ewing, NJ (US)

(73) Assignee: Universal Display Corporation, Ewing, NJ (US)

( * ) Notice: Subject to any disclaimer, the term of this patent is extended or adjusted under 35 U.S.C. 154(b) by 265 days.

(21) Appl. No.: 15/169,027

(22) Filed: May 31, 2016

(65) Prior Publication Data

US 2017/0345370 A1 Nov. 30, 2017

(51) Int. Cl.

| | |
|---|---|
| ***G09G 3/32*** | (2016.01) |
| ***G09G 3/3258*** | (2016.01) |
| ***G09G 3/3208*** | (2016.01) |

(52) U.S. Cl.

CPC ..... *G09G 3/3258* (2013.01); *G09G 3/3208* (2013.01); *G09G 2300/023* (2013.01); *G09G 2300/0452* (2013.01); *G09G 2310/0297* (2013.01)

(58) Field of Classification Search

CPC .. G09G 3/3233; G09G 3/3208; G09G 3/3258; G09G 3/20; G09G 3/006; H04N 5/23296

USPC ..... 257/40, 79; 345/76, 212, 690, 694, 204, 345/206; 348/240.2

See application file for complete search history.

(56) References Cited

U.S. PATENT DOCUMENTS

| | | | |
|---|---|---|---|
| 4,769,292 | A | 9/1988 | Tang et al. |
| 5,247,190 | A | 9/1993 | Friend et al. |
| 5,703,436 | A | 12/1997 | Forrest et al. |
| 5,707,745 | A | 1/1998 | Forrest et al. |
| 5,834,893 | A | 11/1998 | Bulovic et al. |
| 5,844,363 | A | 12/1998 | Gu et al. |
| 6,013,982 | A | 1/2000 | Thompson et al. |
| 6,087,196 | A | 7/2000 | Sturm et al. |
| 6,091,195 | A | 7/2000 | Forrest et al. |
| 6,097,147 | A | 8/2000 | Baldo et al. |
| 6,294,398 | B1 | 9/2001 | Kim et al. |

(Continued)

FOREIGN PATENT DOCUMENTS

| | | |
|---|---|---|
| EP | 1238981 | 9/2002 |
| JP | 2010/135467 | 6/2010 |

(Continued)

OTHER PUBLICATIONS

Baldo et al., "Highly Efficient Phosphorescent Emission from Organic Electroluminesent Devices," Nature, vol. 395, 151-154, (1998).

(Continued)

*Primary Examiner* — Abdul-Samad A Adediran
(74) *Attorney, Agent, or Firm* — Riverside Law LLP

(57) ABSTRACT

A display according to various embodiments is disclosed. The display has a frontplane including at least one OLED pixel having multiple subpixels connected to at least one power line. A backplane of the display includes at least one driver circuit connected to two or more of the multiple subpixels. Methods for powering the display are also disclosed.

15 Claims, 5 Drawing Sheets

(56) References Cited

U.S. PATENT DOCUMENTS

| | | | | |
|---|---|---|---|---|
| 6,303,238 | B1 | 10/2001 | Thompson et al. | |
| 6,337,102 | B1 | 1/2002 | Forrest et al. | |
| 6,468,819 | B1 | 10/2002 | Kim et al. | |
| 7,279,704 | B2 | 10/2007 | Walters et al. | |
| 7,431,968 | B1 | 10/2008 | Shtein et al. | |
| 7,968,146 | B2 | 6/2011 | Wanger et al. | |
| 2003/0230980 | A1 | 12/2003 | Forrest et al. | |
| 2004/0174116 | A1 | 9/2004 | Lu et al. | |
| 2004/0262614 | A1* | 12/2004 | Hack | G09G 3/3258 257/79 |
| 2005/0104818 | A1* | 5/2005 | Kwak | G09G 3/3233 345/76 |
| 2010/0013867 | A1* | 1/2010 | Kim | G09G 3/3233 345/690 |
| 2011/0043500 | A1* | 2/2011 | Kwak | G09G 3/006 345/206 |
| 2013/0026452 | A1 | 1/2013 | Kottas et al. | |
| 2013/0119354 | A1 | 5/2013 | Ma et al. | |
| 2013/0335395 | A1* | 12/2013 | Zhan | G09G 3/3233 345/212 |
| 2014/0035890 | A1* | 2/2014 | Jinta | G09G 3/20 345/204 |
| 2014/0077163 | A1* | 3/2014 | Hack | G09G 3/3258 257/40 |
| 2014/0176767 | A1* | 6/2014 | Hamel | H04N 5/23296 348/240.2 |
| 2014/0313242 | A1* | 10/2014 | Kaplan | G09G 3/3208 345/694 |
| 2014/0327709 | A1* | 11/2014 | Hack | G09G 3/3208 345/694 |
| 2014/0354701 | A1* | 12/2014 | Yeo | G09G 3/3208 345/690 |

FOREIGN PATENT DOCUMENTS

| | | |
|---|---|---|
| WO | 2004/111066 | 12/2004 |
| WO | 2008/044723 | 4/2008 |
| WO | 2008057394 | 5/2008 |
| WO | 2010011390 | 1/2010 |
| WO | 2010/111175 | 9/2010 |

OTHER PUBLICATIONS

Baldo et al., "Very high-efficiency green organic light-emitting devices based on electrophosphorescence," Appl. Phys. Lett., vol. 75, No. 1, 4-6 (1999).

* cited by examiner

ARCHITECTURE FOR VERY HIGH RESOLUTION AMOLED DISPLAY BACKPLANE

PARTIES TO A JOINT RESEARCH AGREEMENT

The claimed invention was made by, on behalf of, and/or in connection with one or more of the following parties to a joint university corporation research agreement: Regents of the University of Michigan, Princeton University, University of Southern California, and the Universal Display Corporation. The agreement was in effect on and before the date the claimed invention was made, and the claimed invention was made as a result of activities undertaken within the scope of the agreement.

FIELD OF THE INVENTION

The present invention relates to an architecture for a high resolution display backplane and devices such as organic light emitting diodes and other devices, including the same.

BACKGROUND

Opto-electronic devices that make use of organic materials are becoming increasingly desirable for a number of reasons. Many of the materials used to make such devices are relatively inexpensive, so organic opto-electronic devices have the potential for cost advantages over inorganic devices. In addition, the inherent properties of organic materials, such as their flexibility, may make them well suited for particular applications such as fabrication on a flexible substrate. Examples of organic opto-electronic devices include organic light emitting devices (OLEDs), organic phototransistors, organic photovoltaic cells, and organic photodetectors. For OLEDs, the organic materials may have performance advantages over conventional materials. For example, the wavelength at which an organic emissive layer emits light may generally be readily tuned with appropriate dopants.

OLEDs make use of thin organic films that emit light when voltage is applied across the device. OLEDs are becoming an increasingly interesting technology for use in applications such as flat panel displays, illumination, and backlighting. Several OLED materials and configurations are described in U.S. Pat. Nos. 5,844,363, 6,303,238, and 5,707,745, which are incorporated herein by reference in their entirety.

One application for phosphorescent emissive molecules is a full color display. Industry standards for such a display call for pixels adapted to emit particular colors, referred to as "saturated" colors. In particular, these standards call for saturated red, green, and blue pixels. Color may be measured using CIE coordinates, which are well known to the art.

One example of a green emissive molecule is tris(2-phenylpyridine) iridium, denoted $Ir(ppy)_3$, which has the following structure:

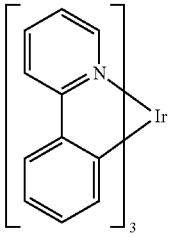

In this, and later figures herein, we depict the dative bond from nitrogen to metal (here, Ir) as a straight line.

As used herein, the term "organic" includes polymeric materials as well as small molecule organic materials that may be used to fabricate organic opto-electronic devices. "Small molecule" refers to any organic material that is not a polymer, and "small molecules" may actually be quite large. Small molecules may include repeat units in some circumstances. For example, using a long chain alkyl group as a substituent does not remove a molecule from the "small molecule" class. Small molecules may also be incorporated into polymers, for example as a pendent group on a polymer backbone or as a part of the backbone. Small molecules may also serve as the core moiety of a dendrimer, which consists of a series of chemical shells built on the core moiety. The core moiety of a dendrimer may be a fluorescent or phosphorescent small molecule emitter. A dendrimer may be a "small molecule," and it is believed that all dendrimers currently used in the field of OLEDs are small molecules.

As used herein, "top" means furthest away from the substrate, while "bottom" means closest to the substrate. Where a first layer is described as "disposed over" a second layer, the first layer is disposed further away from substrate. There may be other layers between the first and second layer, unless it is specified that the first layer is "in contact with" the second layer. For example, a cathode may be described as "disposed over" an anode, even though there are various organic layers in between.

As used herein, "solution processible" means capable of being dissolved, dispersed, or transported in and/or deposited from a liquid medium, either in solution or suspension form.

A ligand may be referred to as "photoactive" when it is believed that the ligand directly contributes to the photoactive properties of an emissive material. A ligand may be referred to as "ancillary" when it is believed that the ligand does not contribute to the photoactive properties of an emissive material, although an ancillary ligand may alter the properties of a photoactive ligand.

As used herein, and as would be generally understood by one skilled in the art, a first "Highest Occupied Molecular Orbital" (HOMO) or "Lowest Unoccupied Molecular Orbital" (LUMO) energy level is "greater than" or "higher than" a second HOMO or LUMO energy level if the first energy level is closer to the vacuum energy level. Since ionization potentials (IP) are measured as a negative energy relative to a vacuum level, a higher HOMO energy level corresponds to an IP having a smaller absolute value (an IP that is less negative). Similarly, a higher LUMO energy level corresponds to an electron affinity (EA) having a smaller absolute value (an EA that is less negative). On a conventional energy level diagram, with the vacuum level at the top, the LUMO energy level of a material is higher than the HOMO energy level of the same material. A "higher" HOMO or LUMO energy level appears closer to the top of such a diagram than a "lower" HOMO or LUMO energy level.

As used herein, and as would be generally understood by one skilled in the art, a first work function is "greater than" or "higher than" a second work function if the first work function has a higher absolute value. Because work functions are generally measured as negative numbers relative to vacuum level, this means that a "higher" work function is more negative. On a conventional energy level diagram, with the vacuum level at the top, a "higher" work function is illustrated as further away from the vacuum level in the downward direction. Thus, the definitions of HOMO and LUMO energy levels follow a different convention than work functions.

More details on OLEDs, and the definitions described above, can be found in U.S. Pat. No. 7,279,704, which is incorporated herein by reference in its entirety.

AMOLED displays are comprised of multiple pixels that together render a visual image on the display. Each pixel is comprised of multiple sub-pixels that when combined usually form white light. AMOLED sub-pixel driving circuits require anywhere from 2 to 7 (or more) TFTs per sub-pixel to correct for TFT non-uniformities and instabilities (change in current over time as threshold voltages change). Given that TFTs deposited on glass or plastic are usually deposited over large area substrates to reduce cost per device, minimum feature sizes that can be patterned are usually of the order of 2 microns (um). This limits the minimum size of any sub-pixel circuit, resulting in a display maximum resolution of 600 to 1,000 dpi. OLED frontplane resolution can be inherently higher than the backplane as a white plus color filter approach can be used so each OLED pixel is unpatterned, and the color filters can be defined by lithography, enabling greater than 1000 dpi resolution OLED frontplane. Accordingly, backplane circuits currently limit AMOLED display resolution.

There is now great interest in using AMOLED displays for VR (virtual reality) and AR (augmented reality) applications. To achieve 3D and VR/AR effects, very high resolution is required, often greater than 1,000 dpi. OLED microdisplays already have resolutions greater than 1000 dpi, but these are fabricated on single crystal silicon substrates where much smaller TFT design features can be employed. For new VR applications, displays of the order of 6" in size are required, and silicon will be too expensive to be used as the substrate. This invention enables very high resolution displays to be built on glass or plastic.

Thus, it is desirable to increase (potentially triple or more) display resolution while lowering display costs, by reducing the number of driver chips. For a small display (e.g. cell phone size) the display drivers are a significant portion of the Bill of Materials (20%-30%) as their cost scales with resolution, while the backplane and frontplane display costs scale with area. Reducing the number of driver chips by 50% or even 75% can therefore significantly lower display fabrication costs. Given that the backplane currently limits AMOLED display resolution (on glass or plastic), increasing the number of OLED sub-pixels that can be driven without increasing the number of backplane circuits will enable higher resolution OLED displays.

SUMMARY OF THE INVENTION

According to one embodiment, a display includes a frontplane having at least one OLED pixel having a plurality of subpixels connected to at least one power line; and a backplane having at least one driver circuit connected to two or more of the plurality of subpixels. In one embodiment, the two or more subpixels are part of the same OLED pixel. In one embodiment, at least one of the two or more subpixels is part of a first OLED pixel and at least one of the two or more subpixels is part of a second OLED pixel. In one embodiment, the at least one driver circuit receives data from a single data line. In one embodiment, two or more subpixels driven by the same scan line receive data from the same data line. In one embodiment, each subpixel of the at least one OLED pixel is powered by the same power line. In one embodiment, each subpixel of the at least one OLED pixel is powered by a different power line. In one embodiment, when the display includes two or more power lines, the first and second power lines are configured to be energized with duty cycles out of phase with each other. In one embodiment, each subpixel of the at least one OLED pixel is driven by the same driver circuit. In one embodiment, each driver circuit is configured to drive at least two of the subpixels nearest to each respective driver circuit. In one embodiment, the backplane is formed on a glass or plastic substrate. In one embodiment, the display is at least 800 dpi. In one embodiment, the display is at least 1,000 dpi. In one embodiment, the display is between 1 and 8 inches diagonal. In one embodiment, the display is an AMOLED display. In one embodiment, a method for multiplexing the display includes the steps of activating a scan line to activate a plurality of driver circuits; energizing a first power line during a first period; and energizing a second power line during a second period. In one embodiment, the first and second period run consecutively. In one embodiment, a method for multiplexing the display includes the steps of energizing a first power line during a first scan per frame; and energizing a second power line during a second scan per frame. In one embodiment, the first and second scans run consecutively. In one embodiment, the total number of driver circuits is less than the total number of subpixels. In one embodiment, a total number of driver circuits is no more than half the number of total subpixels. In one embodiment, a total number of driver circuits is no more than one third the number of total subpixels. In one embodiment, a total number of driver circuits is no more than one quarter the number of total subpixels. In one embodiment, a product including the display is selected from the group consisting of a virtual reality display, an eyewear display, a headset display, a flat panel display, a computer monitor, a medical monitor, a television, a billboard, a light for interior or exterior illumination and/or signaling, a heads up display, a fully transparent display, a flexible display, a laser printer, a telephone, a cell phone, a personal digital assistant, a laptop computer, a digital camera, a camcorder, a viewfinder, a micro-display, a virtual reality display, an augmented reality display, a vehicle, a large area wall, a theater or stadium screen, and a sign. In one embodiment, the display includes a first organic light emitting device. In one embodiment, the first organic light emitting device can include an anode, a cathode, and an organic layer, disposed between the anode and the cathode.

DETAILED DESCRIPTION

Figure 1:
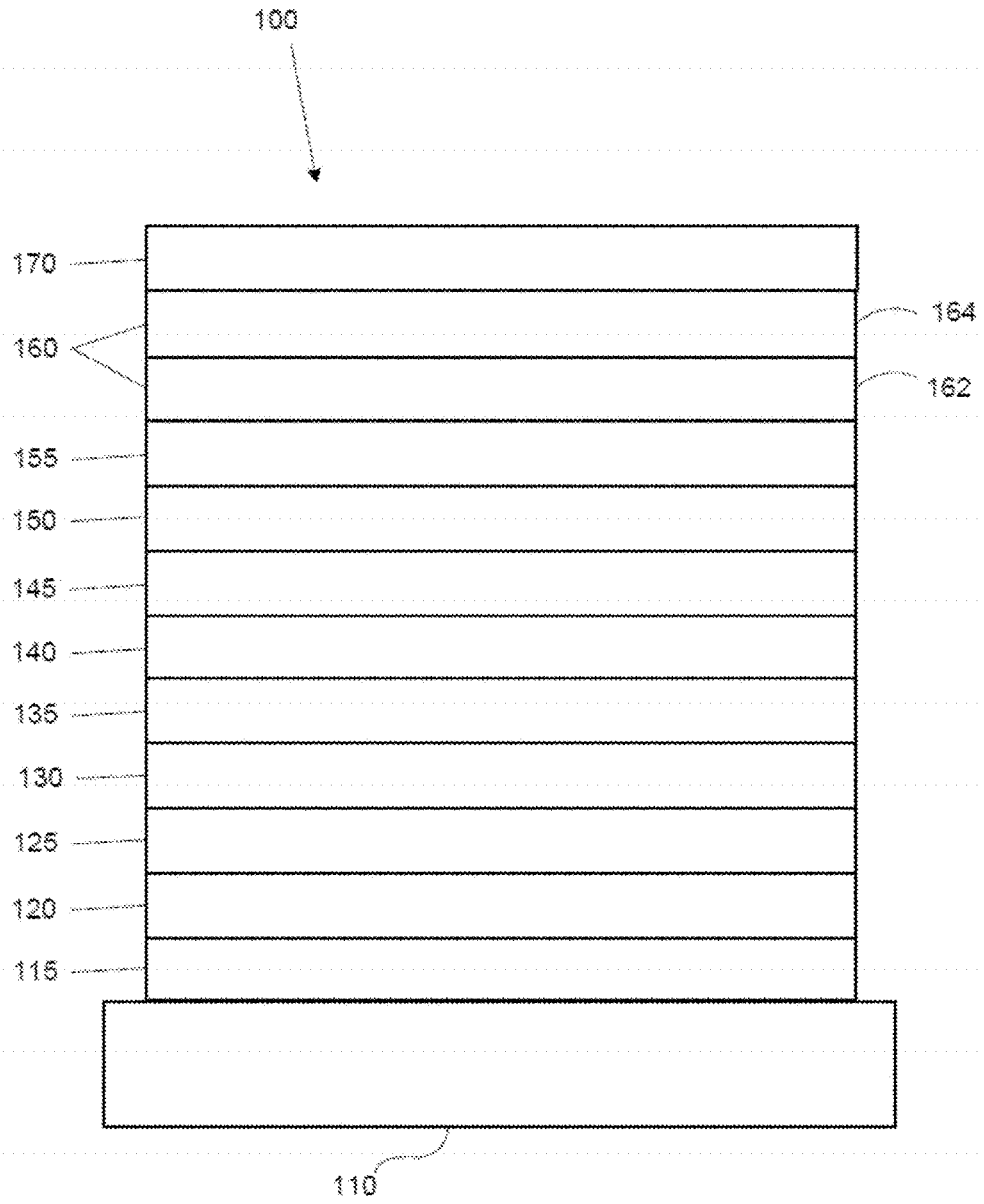
FIG. 1 shows an organic light emitting device.

It is to be understood that the figures and descriptions of the present invention have been simplified to illustrate elements that are relevant for a more clear comprehension of the present invention, while eliminating, for the purpose of clarity, many other elements found in high resolution displays and methods of powering high resolution displays. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, and ±0.1% from the specified value, as such variations are appropriate.

"AMOLED" means Active Matrix OLED

"AR" means augmented reality.

"OLED" means organic light-emitting diode.

"VR" means virtual reality.

Ranges: throughout this disclosure, various aspects of the invention can be presented in a range format. It should be understood that the description in range format is merely for convenience and brevity and should not be construed as an inflexible limitation on the scope of the invention. Where appropriate, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Generally, an OLED comprises at least one organic layer disposed between and electrically connected to an anode and a cathode. When a current is applied, the anode injects holes and the cathode injects electrons into the organic layer(s). The injected holes and electrons each migrate toward the oppositely charged electrode. When an electron and hole localize on the same molecule, an "exciton," which is a localized electron-hole pair having an excited energy state, is formed. Light is emitted when the exciton relaxes via a photoemissive mechanism. In some cases, the exciton may be localized on an excimer or an exciplex. Non-radiative mechanisms, such as thermal relaxation, may also occur, but are generally considered undesirable.

The initial OLEDs used emissive molecules that emitted light from their singlet states ("fluorescence") as disclosed, for example, in U.S. Pat. No. 4,769,292, which is incorporated by reference in its entirety. Fluorescent emission generally occurs in a time frame of less than 10 nanoseconds.

More recently, OLEDs having emissive materials that emit light from triplet states ("phosphorescence") have been demonstrated. Baldo et al., "Highly Efficient Phosphorescent Emission from Organic Electroluminescent Devices," Nature, vol. 395, 151-154, 1998; ("Baldo-I") and Baldo et al., "Very high-efficiency green organic light-emitting devices based on electrophosphorescence," Appl. Phys. Lett., vol. 75, No. 3, 4-6 (1999) ("Baldo-II"), which are incorporated by reference in their entireties. Phosphorescence is described in more detail in U.S. Pat. No. 7,279,704 at cols. 5-6, which are incorporated by reference.

FIG. 1 shows an organic light emitting device 100. The figures are not necessarily drawn to scale. Device 100 may include a substrate 110, an anode 115, a hole injection layer 120, a hole transport layer 125, an electron blocking layer 130, an emissive layer 135, a hole blocking layer 140, an electron transport layer 145, an electron injection layer 150, a protective layer 155, a cathode 160, and a barrier layer 170. Cathode 160 is a compound cathode having a first conductive layer 162 and a second conductive layer 164. Device 100 may be fabricated by depositing the layers described, in order. The properties and functions of these various layers, as well as example materials, are described in more detail in U.S. Pat. No. 7,279,704 at cols. 6-10, which are incorporated by reference.

More examples for each of these layers are available. For example, a flexible and transparent substrate-anode combination is disclosed in U.S. Pat. No. 5,844,363, which is incorporated by reference in its entirety. An example of a p-doped hole transport layer is m-MTDATA doped with $F_4$-TCNQ at a molar ratio of 50:1, as disclosed in U.S. Patent Application Publication No. 2003/0230980, which is incorporated by reference in its entirety. Examples of emissive and host materials are disclosed in U.S. Pat. No. 6,303,238 to Thompson et al., which is incorporated by reference in its entirety. An example of an n-doped electron transport layer is BPhen doped with Li at a molar ratio of 1:1, as disclosed in U.S. Patent Application Publication No. 2003/0230980, which is incorporated by reference in its entirety. U.S. Pat. Nos. 5,703,436 and 5,707,745, which are incorporated by reference in their entireties, disclose examples of cathodes including compound cathodes having a thin layer of metal such as Mg:Ag with an overlying transparent, electrically-conductive, sputter-deposited ITO layer. The theory and use of blocking layers is described in more detail in U.S. Pat. No. 6,097,147 and U.S. Patent Application Publication No. 2003/0230980, which are incorporated by reference in their entireties. Examples of injection layers are provided in U.S. Patent Application Publication No. 2004/0174116, which is incorporated by reference in its entirety. A description of protective layers may be found in U.S. Patent Application Publication No. 2004/0174116, which is incorporated by reference in its entirety.

Figure 2:
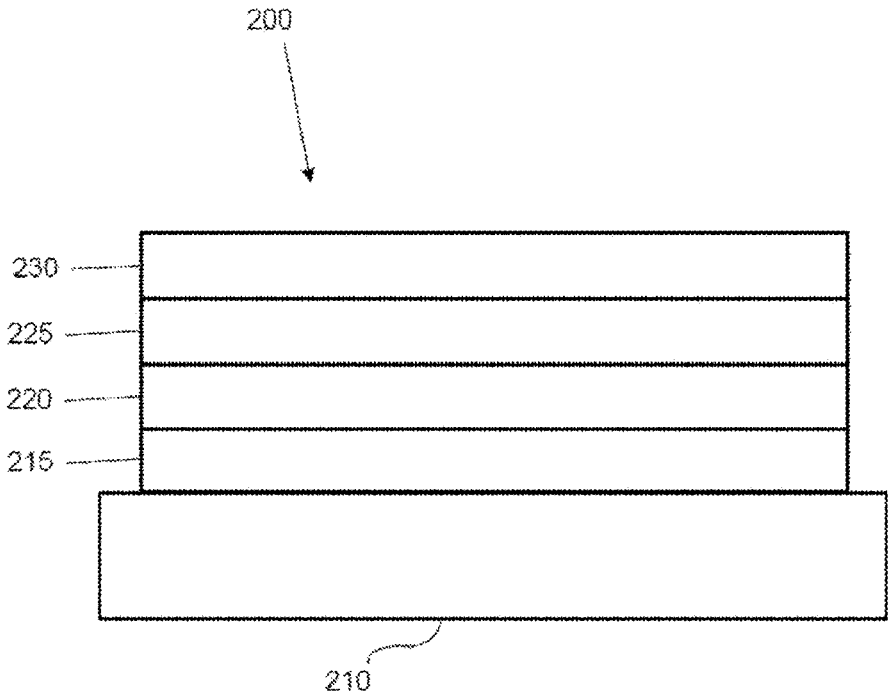
FIG. 2 shows an inverted organic light emitting device that does not have a separate electron transport layer.

FIG. 2 shows an inverted OLED 200. The device includes a substrate 210, a cathode 215, an emissive layer 220, a hole transport layer 225, and an anode 230. Device 200 may be fabricated by depositing the layers described, in order. Because the most common OLED configuration has a cathode disposed over the anode, and device 200 has cathode 215 disposed under anode 230, device 200 may be referred to as an "inverted" OLED. Materials similar to those described with respect to device 100 may be used in the corresponding layers of device 200. FIG. 2 provides one example of how some layers may be omitted from the structure of device 100.

The simple layered structure illustrated in FIGS. 1 and 2 is provided by way of non-limiting example, and it is understood that embodiments of the invention may be used in connection with a wide variety of other structures. The specific materials and structures described are exemplary in nature, and other materials and structures may be used. Functional OLEDs may be achieved by combining the various layers described in different ways, or layers may be omitted entirely, based on design, performance, and cost factors. Other layers not specifically described may also be included. Materials other than those specifically described may be used. Although many of the examples provided herein describe various layers as comprising a single material, it is understood that combinations of materials, such as a mixture of host and dopant, or more generally a mixture, may be used. Also, the layers may have various sublayers. The names given to the various layers herein are not intended to be strictly limiting. For example, in device 200, hole transport layer 225 transports holes and injects holes into emissive layer 220, and may be described as a hole transport layer or a hole injection layer. In one embodiment, an OLED may be described as having an "organic layer" disposed between a cathode and an anode. This organic layer may comprise a single layer, or may further comprise multiple layers of different organic materials as described, for example, with respect to FIGS. 1 and 2.

Structures and materials not specifically described may also be used, such as OLEDs comprised of polymeric materials (PLEDs) such as disclosed in U.S. Pat. No. 5,247,190 to Friend et al., which is incorporated by reference in its entirety. By way of further example, OLEDs having a single organic layer may be used. OLEDs may be stacked, for example as described in U.S. Pat. No. 5,707,745 to Forrest et al, which is incorporated by reference in its entirety. The OLED structure may deviate from the simple layered structure illustrated in FIGS. 1 and 2. For example, the substrate may include an angled reflective surface to improve outcoupling, such as a mesa structure as described in U.S. Pat. No. 6,091,195 to Forrest et al., and/or a pit structure as described in U.S. Pat. No. 5,834,893 to Bulovic et al., which are incorporated by reference in their entireties.

Unless otherwise specified, any of the layers of the various embodiments may be deposited by any suitable method. For the organic layers, preferred methods include thermal evaporation, ink-jet, such as described in U.S. Pat. Nos. 6,013,982 and 6,087,196, which are incorporated by reference in their entireties, organic vapor phase deposition (OVPD), such as described in U.S. Pat. No. 6,337,102 to Forrest et al., which is incorporated by reference in its entirety, and deposition by organic vapor jet printing (OVJP), such as described in U.S. Pat. No. 7,431,968, which is incorporated by reference in its entirety. Other suitable deposition methods include spin coating and other solution based processes. Solution based processes are preferably carried out in nitrogen or an inert atmosphere. For the other layers, preferred methods include thermal evaporation. Preferred patterning methods include deposition through a mask, cold welding such as described in U.S. Pat. Nos. 6,294,398 and 6,468,819, which are incorporated by reference in their entireties, and patterning associated with some of the deposition methods such as ink-jet and OVJD. Other methods may also be used. The materials to be deposited may be modified to make them compatible with a particular deposition method. For example, substituents such as alkyl and aryl groups, branched or unbranched, and preferably containing at least 3 carbons, may be used in small molecules to enhance their ability to undergo solution processing. Substituents having 20 carbons or more may be used, and 3-20 carbons is a preferred range. Materials with asymmetric structures may have better solution processibility than those having symmetric structures, because asymmetric materials may have a lower tendency to recrystallize. Dendrimer substituents may be used to enhance the ability of small molecules to undergo solution processing.

Devices fabricated in accordance with embodiments of the present invention may further optionally comprise a barrier layer. One purpose of the barrier layer is to protect the electrodes and organic layers from damaging exposure to harmful species in the environment including moisture, vapor and/or gases, etc. The barrier layer may be deposited over, under or next to a substrate, an electrode, or over any other parts of a device including an edge. The barrier layer may comprise a single layer, or multiple layers. The barrier layer may be formed by various known chemical vapor deposition techniques and may include compositions having a single phase as well as compositions having multiple phases. Any suitable material or combination of materials may be used for the barrier layer. The barrier layer may incorporate an inorganic or an organic compound or both. The preferred barrier layer comprises a mixture of a polymeric material and a non-polymeric material as described in U.S. Pat. No. 7,968,146, PCT Pat. Application Nos. PCT/US2007/023098 and PCT/US2009/042829, which are herein incorporated by reference in their entireties. To be considered a "mixture", the aforesaid polymeric and non-polymeric materials comprising the barrier layer should be deposited under the same reaction conditions and/or at the same time. The weight ratio of polymeric to non-polymeric material may be in the range of 95:5 to 5:95. The polymeric material and the non-polymeric material may be created from the same precursor material. In one example, the mixture of a polymeric material and a non-polymeric material consists essentially of polymeric silicon and inorganic silicon.

Devices fabricated in accordance with embodiments of the invention can be incorporated into a wide variety of electronic component modules (or units) that can be incorporated into a variety of electronic products or intermediate components. Examples of such electronic products or intermediate components include display screens, lighting devices such as discrete light source devices or lighting panels, etc. that can be utilized by the end-user product manufacturers. Such electronic component modules can optionally include the driving electronics and/or power source(s). Devices fabricated in accordance with embodiments of the invention can be incorporated into a wide variety of consumer products that have one or more of the electronic component modules (or units) incorporated therein. Such consumer products would include any kind of products that include one or more light source(s) and/or one or more of some type of visual displays. Some examples of such consumer products include virtual reality displays, an eyewear display, a headset display, a flat panel display, a computer monitor, a medical monitor, a television, a billboard, a light for interior or exterior illumination and/or signaling, a heads up display, a fully transparent display, a flexible display, a laser printer, a telephone, a cell phone, a personal digital assistant, a laptop computer, a digital camera, a camcorder, a viewfinder, a micro-display, an AR display, a VR display, a vehicle, a large area wall, a theater or stadium screen, and a sign. Various control mechanisms may be used to control devices fabricated in accordance with the present invention, including passive matrix and active matrix. Many of the devices are intended for use in a temperature range comfortable to humans, such as 18 degrees C. to 30 degrees C., and more preferably at room temperature (20-25 degrees C.), but could be used outside this temperature range, for example, from −40 degree C. to +80 degree C.

In embodiments of a new architecture for a high resolution display, time multiplexing of the power lines is utilized to reduce the number of data lines and associated pixel circuits. This approach is very amenable to small area displays.

Figure 3:
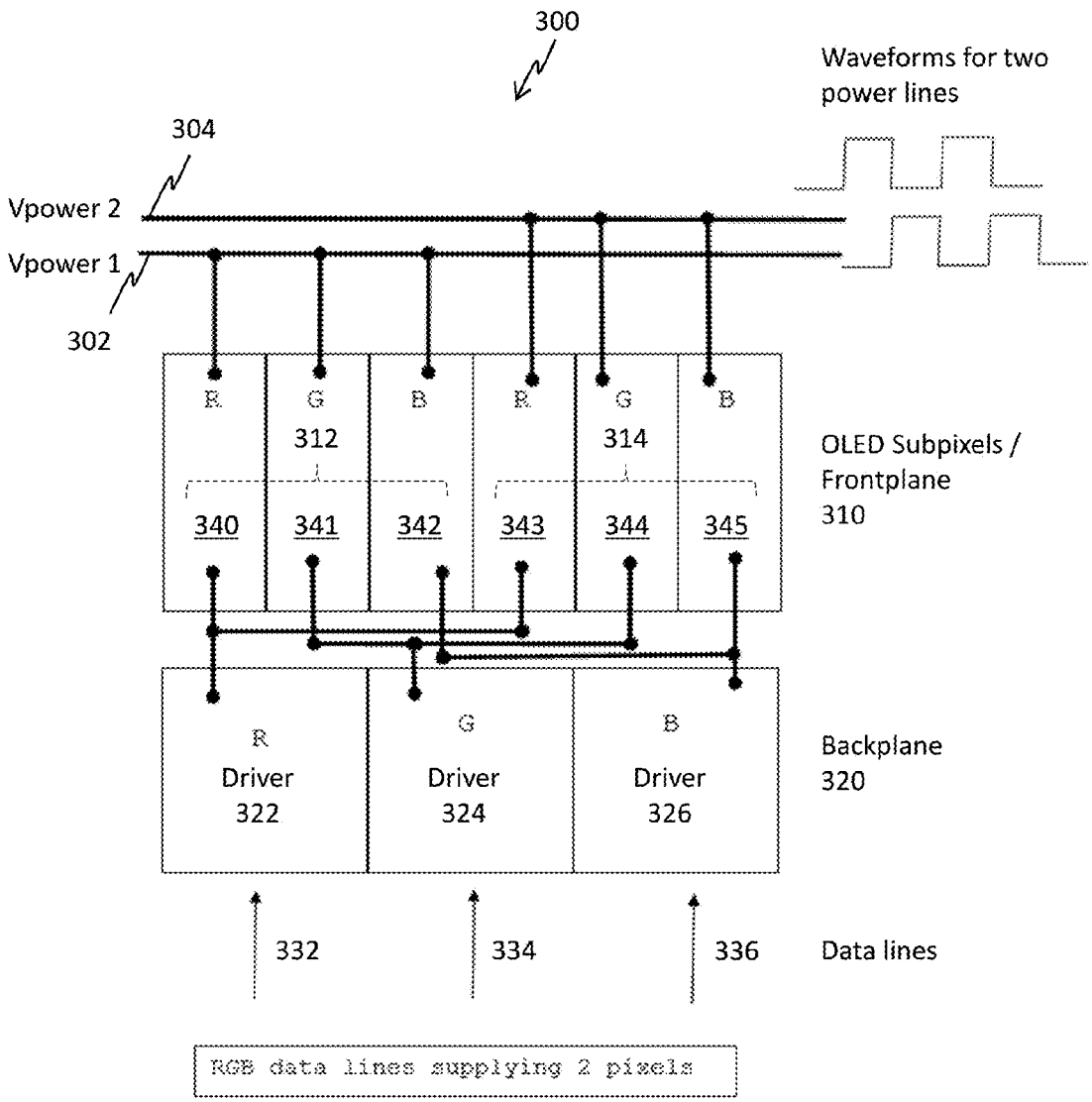
FIG. 3 shows a schematic of a display drive architecture according to one embodiment.

With reference now to FIG. 3, according to one embodiment, a display architecture 300 includes a frontplane 310 having a first pixel (left RGB, 312) connected to a first power line 302 and a second pixel (left RGB, 314) connected to a second power line 304. The backplane 320 has three driver circuits 322, 324, 326 connected to subpixels 340, 341, 342, 342, 343, 344, 345 of the first and second pixels 312, 314. In this embodiment, each driver circuit 322, 324, 326 corresponds with a color subpixel (red, green or blue) of each pixel 312, 314. In one embodiment, the frontplane 310 has at least one OLED pixel and multiple subpixels are connected to at least one power line. In one embodiment, the backplane has at least one driver circuit connected to two or more subpixels. Two RGB pixels are consequently driven from one set of RGB data lines. As shown in FIG. 3, one set of RGB data lines 332, 334, 336 supply one set of RGB backplane driver circuits 322, 324, 326, one for each color sub-pixel. In this case, the output of each backplane circuit is connected to two OLED sub-pixels, as opposed to one in a conventional display. Therefore, two OLED sub-pixels of the same color will be driven simultaneously by one backplane circuit. In one embodiment, the total number of driver circuits is less than the total number of subpixels. In one embodiment, a total number of driver circuits is no more than half the number of total subpixels. In one embodiment, a total number of driver circuits is no more than one third the number of total subpixels. In one embodiment, a total number of driver circuits is no more than one quarter the number of total subpixels. Subpixel colors are not limited to red, green and blue, as subpixel colors known in the art or any subpixel color combination would benefit from the embodiments described herein. The number of subpixels per pixel is also not limited to 3, as the number of subpixels per pixel could be 2, 3, 4, 5 or more.

To avoid both subpixels being illuminated at the same time, (and one with incorrect luminance level) two global power connections are used 302, 304, instead of only one as in a conventional display, to supply power to the OLED sub-pixels. In one embodiment, each global power line is energized 50% of the time, with duty cycles that are out of phase, such as 180 degrees out of phase. By powering out of phase, at any given time, only one of the two OLED sub-pixels connected to each backplane circuit will be illuminated and so emit light according to the signal provided from the driver chip through the data line connection. Methods for powering the circuits are described in further detail below. The display in certain embodiments may use either of the method A or method B described below to multiplex which sub-pixel is being illuminated at any given time by which power line is energized.

In the embodiment shown specifically in FIG. 3, the first OLED pixel 312 includes a first, second and third subpixel 340, 341, 342, and the second OLED pixel 314 includes a fourth, fifth and sixth subpixel 343, 344, 345. The first driver 322 is connected via an output line to the first 340 and fourth 343 subpixels, a second driver 324 is connected via an output line to the second 341 and fifth 344 subpixels, and a third driver 326 is connected via an output line to the third 342 and sixth 345 subpixels. The first 302 power line is connected to the first OLED pixel 312 and the second power line 304 is connected to the second OLED pixel 314. Each driver circuit receives data from a single data line. In one embodiment, the first power line 302 is connected to the fourth 343, fifth 344 and sixth 345 subpixels. In one embodiment, the second power line 304 is connected to the first 340, second 341 and third 342 subpixels. In one embodiment, the first 340 and fourth 343 subpixels are the same color. In one embodiment, the first 340 and fourth 343 subpixels are different colors. In one embodiment, the second 341 and fifth 344 subpixels are the same color. In one embodiment, the second 341 and fifth 344 subpixels are different colors. In one embodiment, the third 342 and sixth 345 subpixels are the same color. In one embodiment, the third 342 and sixth 345 subpixels are different colors. In one embodiment, the first 312 and second 314 OLED pixels comprise each of a red, green and blue subpixel. In one embodiment, each driver circuit is configured to drive at least two of the nearest subpixels. In one embodiment, two or more subpixels connected to the same driver circuit are part of the same OLED pixel. Alternatively, two or more subpixels connected to the same driver circuit can be part of different OLED pixels. In one embodiment, at least one of the two or more subpixels are part of a first OLED pixel and at least one of the two or more subpixels are part of a second OLED pixel. In one embodiment, when the display includes two or more power lines, the first and second power lines are configured to be energized with duty cycles out of phase with each other. This is illustrated in the exemplary waveforms shown in FIG. 3.

Figure 4:
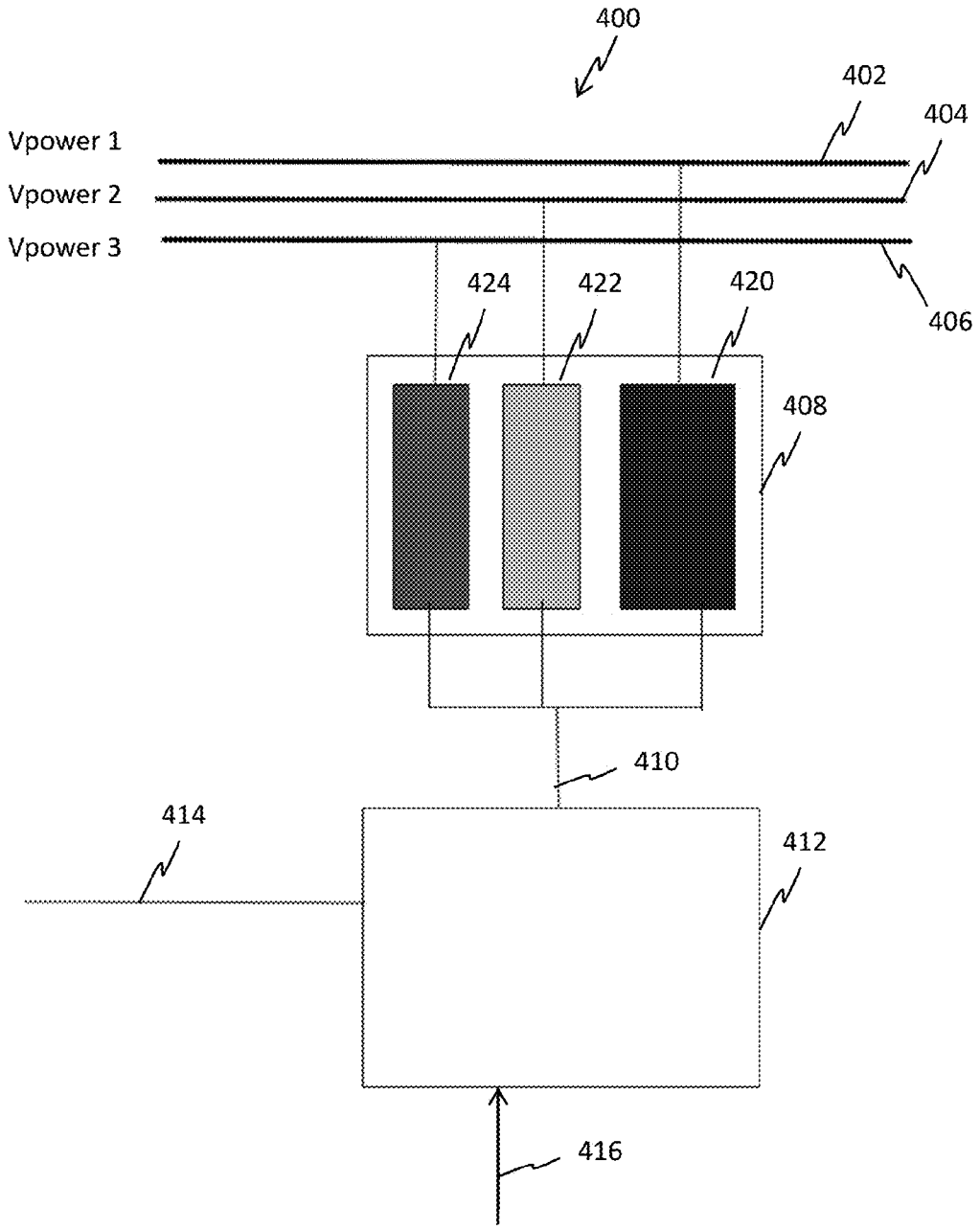
FIG. 4 shows a schematic of a display drive architecture according to one embodiment.

In one embodiment, as shown in FIG. 4, a first 402, second 404 and third 406 power line are connected to a first 420, second 422 and third 424 subpixel respectively in the display frontplane 408. An output line 410 connects the OLED anode to the pixel driver circuit 412. The pixel driver circuit 412 is connected to a data line 416 and a scan line/select circuit 414. In one embodiment, the driver circuit 412 receives data from a single data line 416. In one embodiment, two or more subpixels 420, 422, 426 are driven by the same scan line 414 and receive data from the same data line 416. For example, as shown in FIG. 4, each of a red 424 green 422 and blue 420 subpixels are driven by a single data line 416. Here, each pixel has just one multi-TFT driving circuit, as opposed to 3 or 4 or even 5 circuits in a conventional pixel such as RGB stripe or RGBW or RGB1B2 using red, green, yellow, light blue and deep blue pixels. The output of the driving circuit is connected to all the OLED anodes (or cathode for IOLED) in that pixel, whereas in a conventional display, each sub-pixel circuit only connects to its own OLED sub-pixel. The display in certain embodiments will use either of the method A or method B described below to multiplex which sub-pixel is being illuminated at any given time by which power line is energized. The data line will supply the appropriate data voltage to the pixel addressing circuit for the sub-pixel being illuminated at any instant. This approach will only require one third the number of driving circuits and data lines (for a conventional RGB display) allowing for much higher resolution backplanes and much lower driver chip costs, while still only requiring 5 external interconnections per pixel. While this novel architecture does require more power lines than a conventional display, the driving chips for the switched power lines can be digital, not analog, so will be much lower cost, or it may even be possible to integrate the power line select circuitry directly onto the substrate itself using deposited TFTs.

Figure 5:
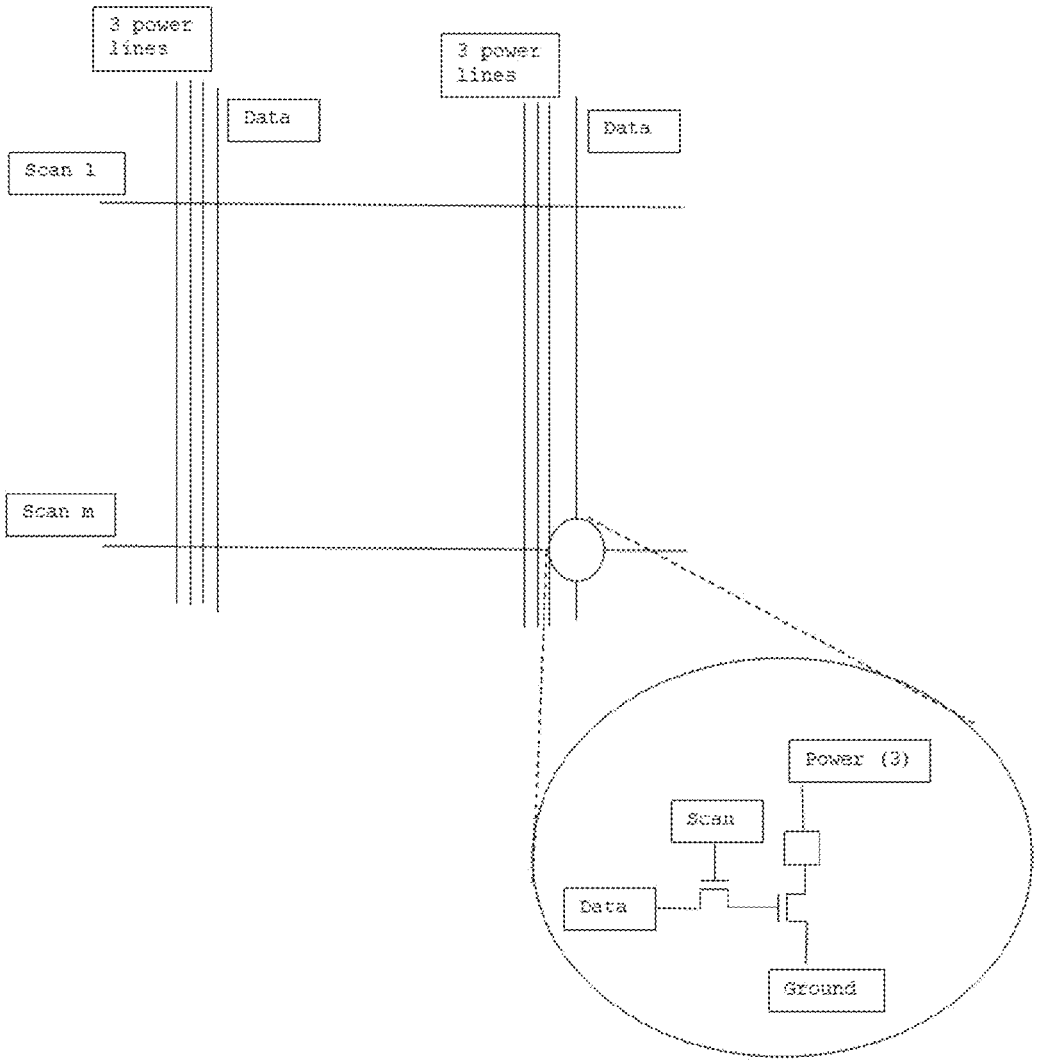
FIG. 5 shows a diagram of an overall display layout for implementation of the drive architecture shown in FIG. 4 according to one embodiment.

In one embodiment, each subpixel of the at least one OLED pixel is powered by a different power line. In one embodiment, each subpixel of the at least one OLED pixel is powered by the same power line. In one embodiment, each subpixel of the at least one OLED pixel is driven by the same driver circuit. An overall display layout of the embodiment shown in FIG. 4 is represented in FIG. 5, for a conventional RGB AMOLED display. Each pixel now has a single scan line, a single data line and three global power lines. This is an improvement over conventional AMOLED displays having one scan line, three data lines and one global power line (where both have 5 external interconnecting lines).

In certain embodiments, there are disparate voltage requirements of the various power lines. For example one or more colors (e.g. a particular set of sub-pixels, such as a set of blue sub-pixels) may require a higher voltage range or maximum in comparison to the power lines powering one or more other colors. This would be particularly true in embodiments where one or more of the sub-pixels (colors) uses a stacked architecture and other sub-pixels contain less stacks or do not have a stacked architecture (e.g. if the blue sub-pixel required a stacked architecture and the yellow did not). Thus, it should be appreciated that any given power line may have any desired voltage requirement suitable for powering any particular pixel or sub-pixel.

Displays according to the embodiments described herein can utilize a backplane that is formed on a glass or plastic or metal substrate. In one embodiment, the display is at least 800 dpi. In one embodiment, the display is at least 1,000 dpi. In one embodiment, the display is between 1 and 8 inches diagonal, but can be smaller or larger for certain applications. In one embodiment, the display is an AMOLED display.

This display can be operated in several ways. One way (Method A) according to one embodiment is for the scan line to activate all the pixel drivers on one scan line, and then the time that the scan line is enabled can be divided into two periods, and one global power line will be energized in the first period, and the second global power line in the second period. This will achieve the desired image but will require the global power lines to be switched every time a new scan line is selected, which is typically of the order of a few microseconds. This method has the advantage of not requiring a faster frame rate or faster scan line addressing (just faster data line addressing) but with a disadvantage of requiring the global power lines to be switched at many KHz, probably consuming excess power.

Another mode of operation (Method B) according to another embodiment is to run the display at a multiple n of the native frame rate that would be used without this invention, and for each frame scan the complete display n times, with each global power line enabled for one of the n scans per frame. The multiple n will be determined by the number of global power lines used to select the sub-pixels to be driven which is equal to the number of sub-pixels driven by any given pixel driving circuit. This would require higher speed addressing (ok for small displays), but only require the global power lines to be switched at the frame rate, which will be much simpler and consume much less power than Method A. Method B may be extended where each backplane circuit drivesmultiple) OLED sub-pixels. These methods require some re-arrangement of the data supplied to the driver chips, so each sub-pixel is fed the correct luminance information versus time.

Thus, according to the methods of powering the display, in one embodiment, a method for multiplexing the display includes the steps of activating a scan line to activate multiple driver circuits, energizing a first power line during a first period, and energizing a second power line during a second period. In one embodiment, the first and second period run consecutively. In one embodiment, a method for multiplexing the display includes the steps of energizing a first power line during a first scan per frame, and energizing a second power line during a second scan per frame. In one embodiment, the first and second scans run consecutively.

In another approach, each sub-pixel circuit does not need to just address OLED sub-pixels of the same color, but could drive the nearest two OLED sub-pixels, thereby simplifying the interconnections between backplane and frontplane. This would require further re-arrangement or manipulation of the data provided to the driver chips to enable each subpixel to show the correct and appropriate video information. In this new embodiment, each backplane circuit will supply luminance information to two separate OLED sub-pixels of different colors (and multiplexed using the global power lines as shown), but the data lines will now supply luminance information for different color sub-pixels, depending on which OLED sub-pixel is energized. The video information supplied to the driver chips will need to be re-arranged so the display shows the correct video image.

Using the multiplexing approaches described herein, the number of pixel circuits required to drive an AMOLED display is reduced. Each driving circuit can drive more than one sub-pixel. This is very important for building very high resolution displays. In effect, multiple power lines (n lines) can be used to provide a multiplexing circuit so that each driving circuit can drive n sub-pixels. The higher the value of n, the less data lines, data chips, and backplane circuitry are required for any given display, which is advantageous for both cost and ease of fabrication and allows higher resolution. The tradeoff is the need to run the display at n times its native speed. So if n=3, a normally 120 Hz display would need to run at 360 Hz. In addition, each sub-pixel would not be illuminated for 100% of the time, but only 1/n of the time, so its luminance would need to be increased to n times its luminance if no multiplexing (but for 1/n of the time). Given lifetime decreases approximately to the luminance squared, this approach could potentially decrease display lifetime as compared to no multiplexing. However, for VR applications where a polarizer is not needed, the net lifetime reduction may be very small or negligible. In one embodiment, the display includes a first organic light emitting device. In one embodiment, the first organic light emitting device can include an anode, a cathode, and an organic layer, disposed between the anode and the cathode.

This novel architecture can also work with other display architectures such as the proposed two OLED deposition (yellow and blue) architecture which uses color filters to produce green and red light from the yellow. This will also allow for very high resolution AMOLED displays with reduced number of data drivers. It can also work with 4 sub-pixel architectures (or more), such as white plus color filter, possibly requiring either 4 switched power lines per pixel, or a combination of 2 switched power lines and 2 pixel driving circuits. It can also work with RGB1B2 configurations.

Embodiments of the invention are particularly suited to small AMOLED displays, as it requires the display to be driven at higher frame rates than would be required without this novel architecture. In certain embodiments, an OLED display which normally operates at 60 Hz will need to be driven at 180 Hz using this invention. Small displays are easier to drive at higher frame rates because of the small RC time constants of the data and scan lines. In addition, embodiments of the invention are particularly suited to VR applications, as each pixel will only be driven for 33% of the time (because of the multiplexing of the global power line), as opposed to 100% in a conventional AMOLED display. VR displays will be placed close to the user and a circular polarizer no longer needs to be applied to remove reflected light. In addition these near eye displays will be driven at relatively low luminance levels. Driving each sub-pixel at 3 times the brightness that would be needed if no power line multiplexing was implemented, should therefore not cause any OLED lifetime issues. In other words, for VR applications this display architecture can have the same efficiency and similar lifetime to a conventional mobile display, but with higher resolution and lower cost.

It is understood that the various embodiments described herein are by way of example only, and are not intended to limit the scope of the invention. For example, many of the materials and structures described herein may be substituted with other materials and structures without deviating from the spirit of the invention. The present invention as claimed may therefore include variations from the particular examples and preferred embodiments described herein, as will be apparent to one of skill in the art. It is understood that various theories as to why the invention works are not intended to be limiting. The disclosures of each and every patent, patent application, and publication cited herein are hereby incorporated herein by reference in their entirety.

We claim:

1. A display comprising:

a frontplane comprising OLED pixels, each having a plurality of subpixels;

a first power line configured to be energized periodically and connected to a first set of OLED subpixels;

a second power line configured to be energized periodically when the first power line is not energized, and connected to a second set of OLED subpixels; and a backplane comprising a driver circuit connected to at least one subpixel of the first set of OLED subpixels and at least one subpixel of the second set of OLED subpixels.

2. The display of claim 1, wherein the driver circuit is connected to two or more subpixels of the first set of OLED subpixels.

3. The display of claim 1, wherein the at least one driver circuit receives data from a single data line.

4. The display of claim 1, wherein two or more subpixels of the plurality of subpixels driven by a same scan line receive data from the same data line.

5. The display of claim 1, wherein each subpixel of the first set of OLED subpixels is driven by a same driver circuit.

6. The display of claim 1, wherein the driver circuit is configured to drive at least two of the subpixels nearest to the driver circuit.

7. The display of claim 1, wherein the backplane is formed on a glass or plastic substrate.

8. The display of claim 1, wherein the display is at least 800 dpi.

9. The display of claim 1, wherein the display is between 1 and 8 inches diagonal.

10. The display of claim 1, wherein the display is an AMOLED display.

11. The display of claim 1, wherein a total number of driver circuits is less than a total number of subpixels.

12. The display of claim 1, wherein a total number of driver circuits is no more than half a number of total subpixels.

13. A product comprising the display of claim 1, wherein the product is selected from the group consisting of a virtual reality display, an eyewear display, a headset display, a flat panel display, a computer monitor, a medical monitor, a television, a billboard, a light for interior or exterior illumination or signaling, a heads up display, a fully transparent display, a flexible display, a laser printer, a telephone, a cell phone, a personal digital assistant, a laptop computer, a digital camera, a camcorder, a viewfinder, an augmented reality display, a micro-display, a vehicle, a large area wall, a theater or stadium screen, and a sign.

14. A method for multiplexing a display comprising:

providing the display comprising:

a frontplane comprising first and second sets of OLED subpixels, a first power line connected to all subpixels of the first set of OLED subpixels, a second power line connected to all subpixels of the second set of OLED subpixels, and a backplane comprising a driver circuit connected to at least one subpixel of the first set of OLED sub pixels and at least one subpixel of the second set of OLED subpixels;

activating a scan line to activate a plurality of driver circuits;

energizing the first power line during a first period; and energizing the second power line during a second period;

wherein at most one of the first power line and the second power line are energized at any time.

15. A method for multiplexing a display comprising:

providing the display comprising:

a frontplane comprising a row comprising first and second sets of OLED subpixels, each having a plurality of subpixels, a first power line connected to all subpixels of the first set of OLED subpixels, a second power line connected to all subpixels of the second set of OLED subpixels, and a backplane comprising a driver circuit connected to at least one subpixel of the first set of OLED subpixels and at least one subpixel of the second set of OLED subpixels;

energizing the first power line during a first scan per frame; and energizing the second power line during a second scan per frame.

* * * * *